US006305778B1

(12) United States Patent
Kobayashi et al.

(10) Patent No.: US 6,305,778 B1
(45) Date of Patent: Oct. 23, 2001

(54) INK-JET RECORDING APPARATUS

(75) Inventors: Atsushi Kobayashi; Seiji Mochizuki; Kazuhisa Kawakami; Shigenori Fukasawa; Masahiro Isono; Masahiro Nakamura; Nobutoshi Ohtsuka; Nobuhito Takahashi; Hitoshi Hayakawa; Norihiro Maruyama, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/466,834

(22) Filed: Dec. 20, 1999

Related U.S. Application Data

(62) Division of application No. 08/997,546, filed on Dec. 23, 1997, now Pat. No. 6,036,299.

(30) Foreign Application Priority Data

| | | |
|---|---|---|
| Dec. 24, 1996 | (JP) | 8-355718 |
| Sep. 29, 1997 | (JP) | 9-282871 |
| Sep. 29, 1997 | (JP) | 9-282872 |
| Oct. 21, 1997 | (JP) | 9-306546 |
| Oct. 21, 1997 | (JP) | 9-306547 |

(51) Int. Cl.[7] ..... B41J 2/165

(52) U.S. Cl. ..... 347/30; 347/23; 347/32; 347/33

(58) Field of Search ..... 347/30, 23, 35, 347/32, 33

(56) References Cited

U.S. PATENT DOCUMENTS

| | | | | |
|---|---|---|---|---|
| 4,734,718 | * | 3/1988 | Iwagami et al. | 347/28 |
| 4,970,534 | * | 11/1990 | Terasawa et al. | 347/32 |
| 5,339,102 | * | 8/1994 | Carlotta | 347/32 |
| 5,847,726 | * | 12/1998 | Hori | 347/23 |
| 5,946,015 | * | 8/1999 | Courtney | 347/92 |
| 6,036,299 | * | 3/2000 | Kobayashi et al. | 347/30 |
| 6,042,218 | * | 3/2000 | Nakahara | 347/35 |
| 6,070,959 | * | 6/2000 | Kanbayashi et al. | 347/11 |

FOREIGN PATENT DOCUMENTS

| | | | |
|---|---|---|---|
| 0 273 362 | 7/1988 | (EP) | B41J/3/04 |
| 0 541 519 | 5/1993 | (EP) | B41J/2/165 |
| 0 585 923 | 3/1994 | (EP) | B41J/2/165 |
| 0604 938 | 7/1994 | (EP) . | |
| 0615 846 | 9/1994 | (EP) . | |
| 0 630 754 | 12/1994 | (EP) | B41J/2/165 |
| 0 674 996 | 10/1995 | (EP) | B41J/2/165 |
| 0684 139 | 11/1995 | (EP) . | |

OTHER PUBLICATIONS

Patent Abstracts of Japan vol. 096 No. 002 Feb. 29, 1996, & JP 07 276671 A (Seiko Epson Corp) Oct. 24, 1995 *Abstract.

Patent Abstracts of Japan vol. 014, No. 407 (M–1019) Sep. 4, 1990 & JP 02 155654 A (Canon Inc) Jun. 14, 1990, Abstract.

Patent Abstracts of Japan , vol. 011, No. 330 (M–636) Oct. 28, 1987 & JP 62 113557 A (Canon Inc) May 25, 1987 Abstract.

Patent Abstracts of Japan vol. 011 No. 330 (M–636) Oct. 28, 1987 & JP 62 113555 A (Canon Inc) May 25, 1987 Abstract.

* cited by examiner

*Primary Examiner*—Thinh Nguyen
*Assistant Examiner*—Shih-Wen Hsieh
(74) *Attorney, Agent, or Firm*—Sughrue, Mion, Zinn, Macpeak & Seas, PLLC

(57) ABSTRACT

Ink is sucked in a first amount from recording heads by applying negative pressure of suction pumps to the recording heads in a state in which communication between the recording heads and the atmosphere is cut off by sealing the recording heads by means of caps. The ink in the caps is then discharged by causing negative pressure of the suction pumps to act in a state in which the caps are made to communicate with the atmosphere, and then wiping is effected by a wiping blade.

36 Claims, 15 Drawing Sheets

INK-JET RECORDING APPARATUS

This is a divisional of application Ser. No. 08/997,546 filed Dec. 23, 1997 the disclosure of which is incorporated herein by reference now U.S. Pat. No. 6,036,299.

BACKGROUND OF THE INVENTION

1. Technical Field of the Invention

The present invention relates to an ink-jet type recording apparatus which has a recording head movable in the widthwise direction of recording paper and forms an image on the recording paper by ejecting ink droplets thereto in correspondence with print data, and more particularly to a technique for managing ink in an ink cartridge.

2. Prior Art

An ink-jet type printer is an apparatus which has an ink-jet type recording head which receives a supply of ink from an ink storage means as well as a paper feeding means for relatively moving recording paper with respect to the recording head, and ejects ink droplets to the recording paper while moving the recording head in correspondence with a print signal, thereby effecting recording. In the light of the fact that the ink, i.e., a liquid, is handled, operations are performed, including the filling of ink into the recording head, forcibly sucking and discharging the ink from the recording head to prevent clogging due to the vaporization of an ink solvent, and ejecting ink droplets from nozzle openings in the recording head by supplying drive signals unrelated to print data.

The processing operation for the forcible discharge of the ink, which is effected for overcoming the clogging of the recording head, is commonly referred to as a cleaning operation. This processing is one in which, in a case where printing is resumed after a long period of downtime, or in a case where a user has pressed a cleaning switch to overcome the clogging, the ink droplets are discharged from the nozzle openings by sealing the recording head with a capping means and by allowing negative pressure to act. The cleaning operation is subsequently accompanied by a wiping operation using a wiping blade member formed from an elastic plate such as rubber.

The operation in which the ink droplets are ejected by applying the drive signal to the recording head is commonly referred to as a flushing operation, and is an operation in which broken menisci in the vicinities of nozzle openings are recovered by wiping or the like during the cleaning operation. The flushing operation can also be performed for each fixed period for the purpose of preventing the clogging at the nozzle openings where the amount of ejection of ink droplets is small during printing.

In the light of the fact that ink which dries speedily on the recording paper is used due to high-density arrangement of the nozzle openings and for the improvement of print quality, the following problems are encountered. One problem is that because the sizes of the nozzle openings of the recording head are small, and the ink attached to a plate dries in a very short time, the viscosity of the ink in channels in the nozzle openings, a pressure generating chamber, a reservoir, and the like, which constitute the recording head, increases in a short time, resulting in faulty ejection of ink droplets. Another problem is that the viscosity of the ink attached to the nozzle surface increases due to the discharge of the ink in the cleaning operation, enters the nozzle openings in the subsequent wiping operation, and causes air bubbles to grow due to a pressure change caused by a subsequent flushing operation, with the result that, faulty ejection of ink droplets can result immediately after the cleaning operation.

SUMMARY OF THE INVENTION

In the present invention, there is provided an ink-jet type recording apparatus comprising: an ink-jet type recording head for ejecting ink droplets in correspondence with print data; capping means for sealing the recording head and communicating with the atmosphere selectively, and for receiving negative pressure from a suction pump; a wiping blade for wiping a nozzle opening surface of the recording head; flushing controlling means for controlling flushing in which the ink droplets are ejected from the recording head to prevent the clogging of the nozzle opening of the recording head; and cleaning controlling means for allowing the suction pump to suck ink from the recording head and for allowing the wiping blade to wipe the recording head, wherein the cleaning controlling means causes the ink to be sucked in a first amount from the recording head by the action of negative pressure of the suction pump in a state in which the recording head is sealed by the capping means and the communication with the atmosphere is cut off, then causes the ink in the capping means to be discharged by the action of the negative pressure of the suction pump in a state in which the recording head is sealed by the capping means in communication with the atmosphere, causes wiping to be effected with respect to the recording head by the wiping blade,after releasing the recording head from the capping means, and causes the ink remaining in the capping means to be discharged again in the state in which the capping means is released from the recording head.

Accordingly, a primary object of the present invention is to provide an ink-jet type recording apparatus which is capable of recovering ink-droplet discharging capabilities by allowing the ink with increased viscosity in the recording head to be discharged speedily.

A secondary object of the present invention is to provide an ink-jet type recording apparatus which is capable of reliably overcoming faulty printing immediately after the cleaning operation.

BRIEF DESCRIPTION OF THE DRAWINGS

FIG. 8(*g*) is a waveform diagram illustrating a signal applied to the recording head during the imparting of vibrations;

DESCRIPTION OF THE PREFERRED EMBODIMENTS

Figure 1:
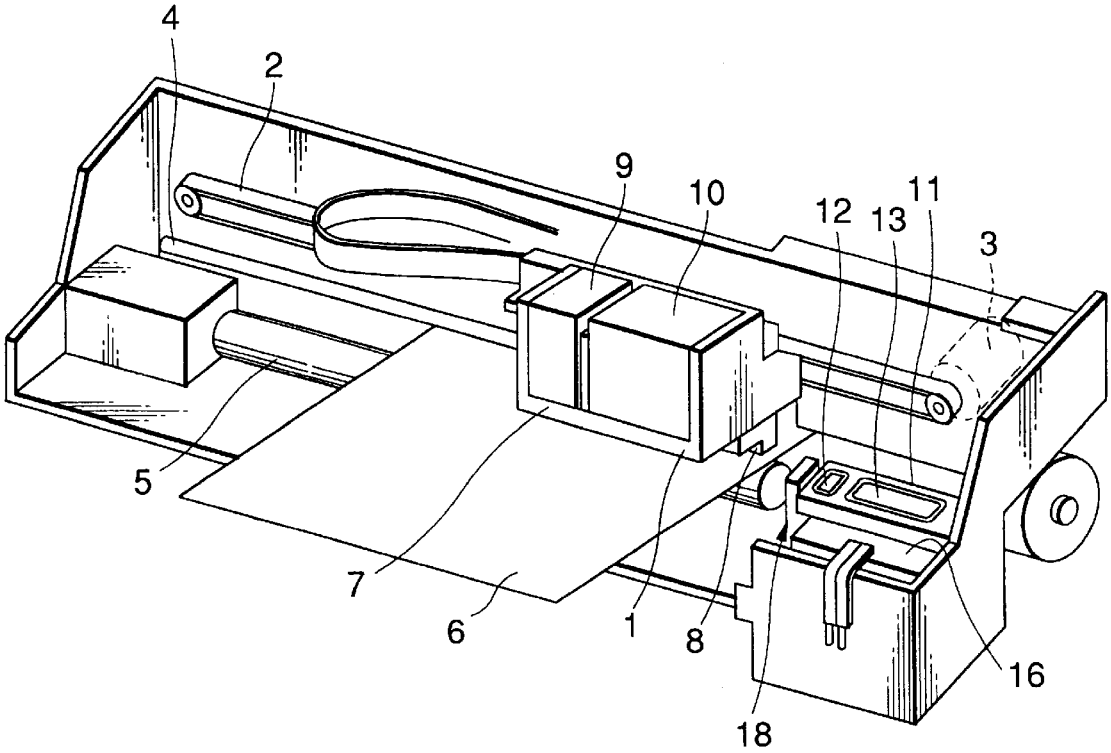
FIG. 1 is a perspective view illustrating an embodiment of an ink-jet type recording apparatus to which the present invention is applied.

FIG. 1 shows an embodiment of the present invention, and a carriage 1 is connected to a motor 3 by means of a timing belt 2, and is arranged to move in parallel with a platen 5 while being guided by a guide member 4. On the surface of the carriage 1 which faces recording paper 6, a recording head 7 for ejecting black ink is mounted on a printing area side (the left-hand side in the drawing) thereof, and a recording head 8 for color printing, which is arranged detachably, is mounted on a nonprinting area side thereof. The recording heads 7 and 8 are adapted to effect printing by receiving the supply of ink from a black ink cartridge 9 and a color ink cartridge 10, respectively, and by ejecting ink droplets to the recording paper 6.

A capping device 11 is arranged such that a cap 12 for sealing the recording head 7 for black ink and a cap 13 for sealing the recording head 8 for color ink are mounted on the same slider, and the capping device 11 is connected via tubes to a pump unit 16 comprised of two suction pumps 14 and 15 (see FIG. 2) which are respectively capable of being driven independently. The caps 12 and 13 have sizes capable of sealing nozzle opening surfaces of the recording heads 7 and 8, and seal the nozzle openings during nonprinting. During the cleaning processing and an ink filling operation, the caps 12 and 13 forcibly discharge ink from the recording heads 7 and 8 by receiving negative pressure from the pump unit 16.

To effectively discharge the ink which was discharged into the caps and remained therein to an unillustrated waste ink tank, the caps 12 and 13 are made to communicate with the atmosphere via air vent valves V1 and V2 whose opening and closing are controlled by the movement of the carriage 1 or by a driving means. In addition, a cleaning unit 18, which is provided with a wiping blade 17 for wiping the nozzle opening surfaces of the recording heads 7 and 8, is disposed in the vicinity of the capping device 11.

Figure 2:
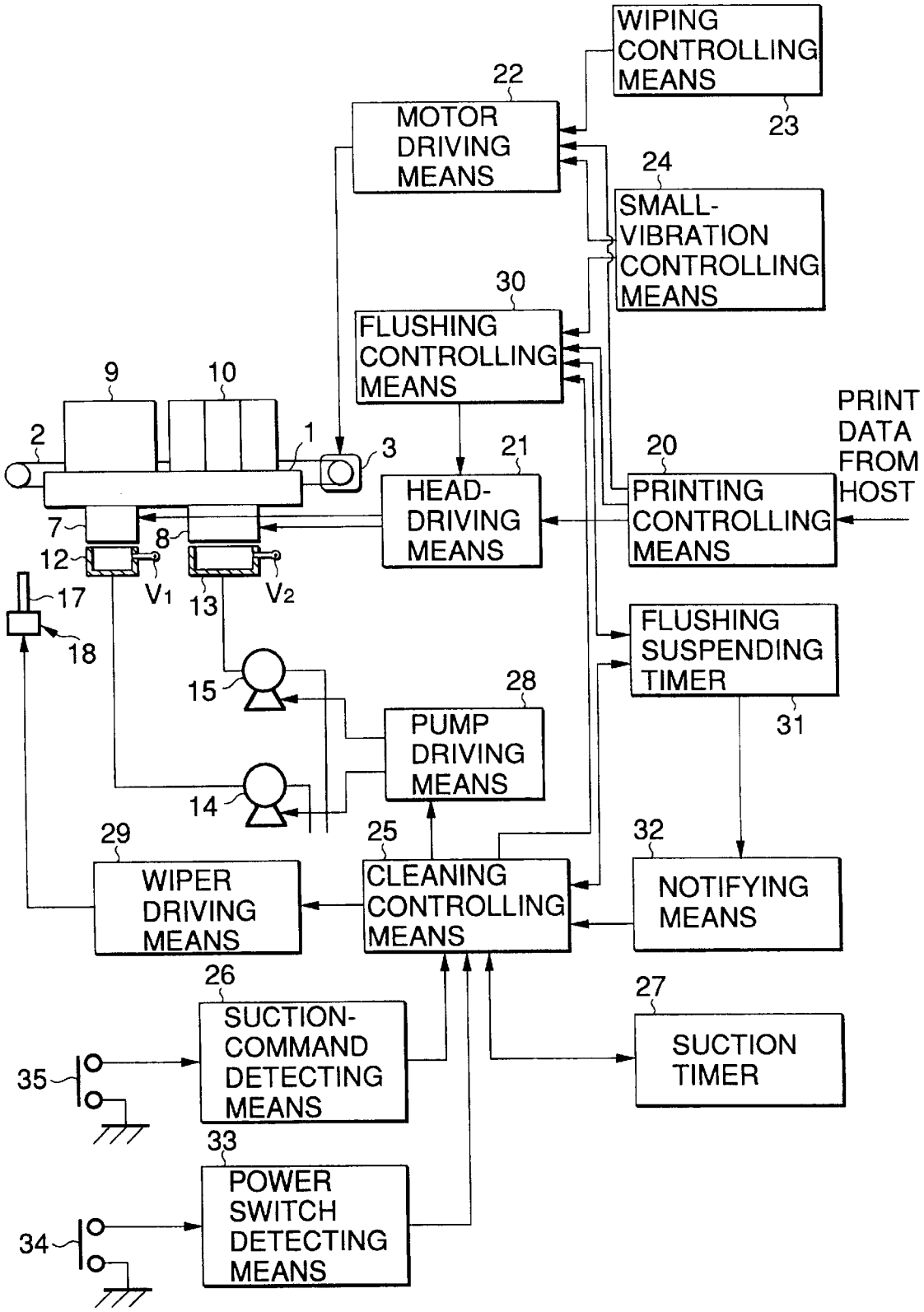
FIG. 2 is a block diagram illustrating the embodiment of the present invention.

FIG. 2 shows an example of a controller for controlling the operation of the above recording apparatus. A printing controlling means 20 generates bit map data on the basis of print data from a host, and generates a drive signal by a head driving means 21 on the basis of this data, so as to eject ink droplets from the recording heads 7 and 8. In addition to the drive signal based on the print data, the head driving means 21 is adapted to output to the recording heads 7 and 8 a drive signal for an operation for ejecting ink droplets by pressurizing a pressure generating chamber for overcoming the clogging or adjusting the menisci, i.e., the so-called flushing operation.

A motor driving means 22 reciprocates the carriage 1 at a fixed speed in the widthwise direction of the recording paper 6 upon receiving a signal from the printing controlling means 20. In addition, at the time of wiping, the motor driving means 22 moves the recording heads 7 and 8 by a wipable distance by being controlled by a wiping controlling means 23, and, during a defoaming process, reciprocates the carriage 1 by a small amount by being controlled by a small-vibration controlling means 24.

When the turning on of the power is detected by a power switch detecting means 33, or upon receipt of a signal from a suction-command detecting means 26, a cleaning controlling means 25 controls a pump driving means 28 on the basis of the suction strength, the suction time, and the suction interval which are prescribed by a suction timer 27 so as to rotatively drive the suction pumps 14 and 15 at predetermined speeds. When wiping is necessary, the cleaning controlling means 25 outputs a signal to a wiper driving means 29 to cause the wiping blade 17 to advance into the passage of movement of the recording heads 7 and 8.

When a flushing command has been issued from the printing controlling means 20 after continuation of the printing operation for a fixed time, and when a suction termination signal has been outputted from the cleaning controlling means 25 and a time-up signal has been outputted from a flushing suspending timer 31 which will be described later, a flushing controlling means 30 moves the recording heads 7 and 8 by the printing controlling means 20 to a flushing position, normally to a position opposing the caps 12 and 13 of the capping device 11 at a fixed interval therewith, and causes a predetermined number of ink droplets to be ejected from all the nozzle openings of the recording heads 7 and 8 so as to prevent the clogging and overcome the clogging of the nozzles.

The flushing suspending timer 31 is arranged to start a timing operation upon completion of the cleaning process, including the forcible discharge of ink from the recording heads 7 and 8 by application of negative pressure to the recording heads 7 and 8, as well as by the wiping of the nozzle opening surfaces by the wiping blade 17. The flushing suspending timer 31 is arranged such that the time is up upon measuring the time required for causing air bubbles occurring in the vicinities of the nozzle openings of the recording heads 7 and 8 in the cleaning process to naturally defoam or to be reduced, e.g., 20 seconds. A time-up signal of the flushing suspending timer 31 is outputted to a notifying means 32 to notify the user of the termination of the suspension of flushing by, for example, changing the form of display on a display means for displaying the message "cleaning being performed" and provided on a panel or the like.

The power switch detecting means 33 detects the operation of a power on/off command switch 34 provided on the panel surface, and supplies driving power to the overall apparatus. When a power-off command is given, the power switch detecting means 33 cuts off the driving power to the apparatus upon completion of predetermined processing.

Incidentally, reference numeral 35 in the drawing denotes a cleaning command switch provided on a control panel of an unillustrated case.

Figure 3:
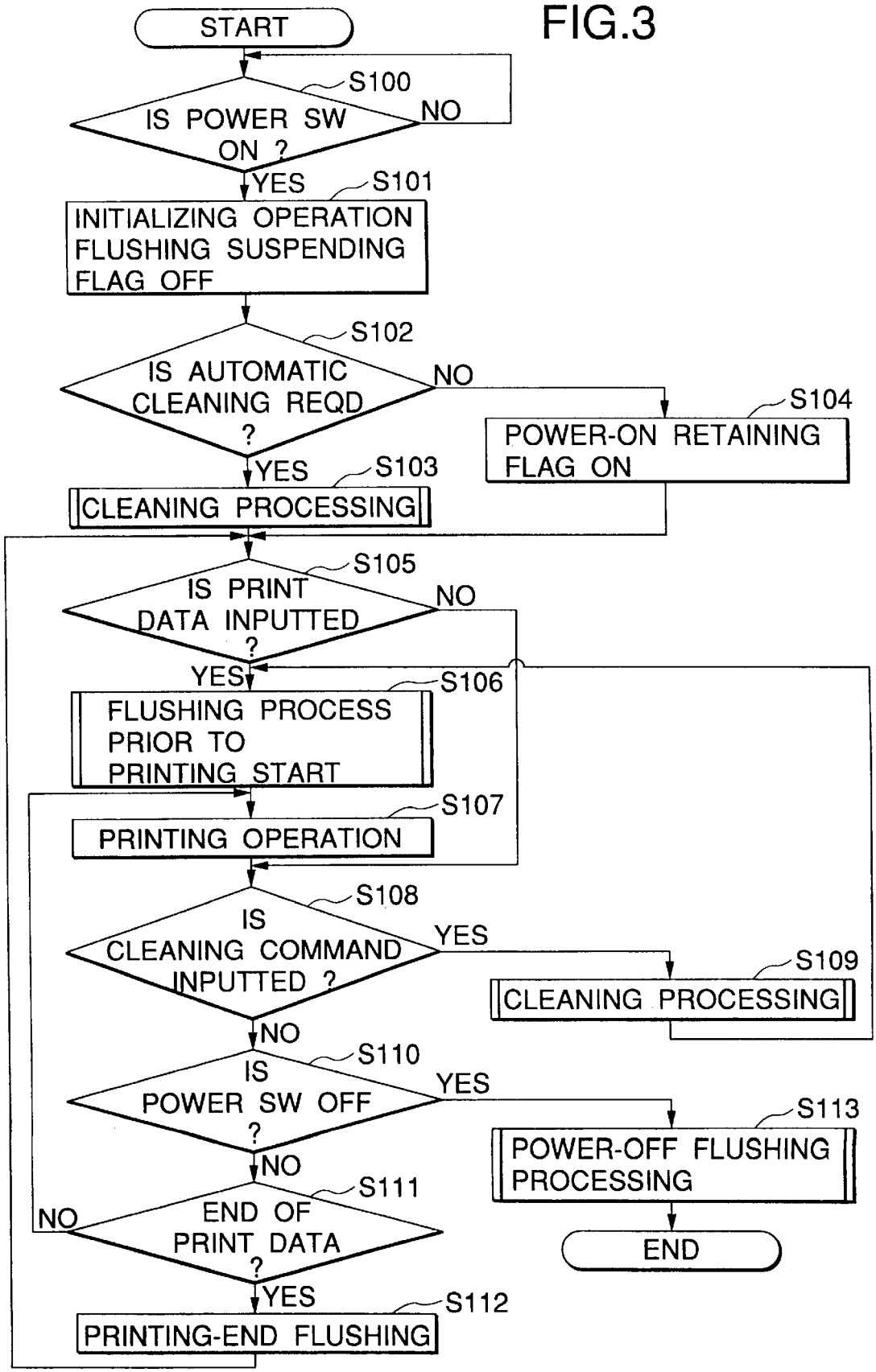
FIG. 3 is a flowchart illustrating the overall operation of the apparatus.

Next, referring to the flowcharts shown in FIGS. 3 to 7, a description will be given of the operation of the apparatus configured as described above. Overall Operation (FIG. 3)

When the on/off command switch 34 is operated and the power is turned on (S100), the printing controlling means 20 executes initialization processing such as the paper discharging operation by means of a paper feeding mechanism and home seeking the carriage 1, and sets a flushing suspending flag to OFF (S101).

The cleaning controlling means 25 determines whether or not automatic cleaning is required during an early period after the turning on of power (S102), and executes cleaning processing, which will be described later, if the idle time of the printing operation has exceeded a prescribed value (S103). If the cleaning processing is not required, the cleaning controlling means 25 sets a power-on suspending flag to ON (S104).

Thus, when a print signal is inputted from the host in the state in which print data is acceptable (S105), a flushing operation prior to a printing start is executed (S106), and upon completion of the flushing operation prior to a printing start, the printing operation is started (S107).

Meanwhile, when the cleaning command switch 35 is operated by the user during the printing period, and a signal is outputted from the cleaning-command detecting means 26 (S108), the cleaning controlling means 25 executes cleaning processing (S109). After the cleaning, the operation jumps to Step S106 in which flushing prior to a printing start is performed to recover the menisci, and then the printing operation is resumed (S107).

Figure 4:
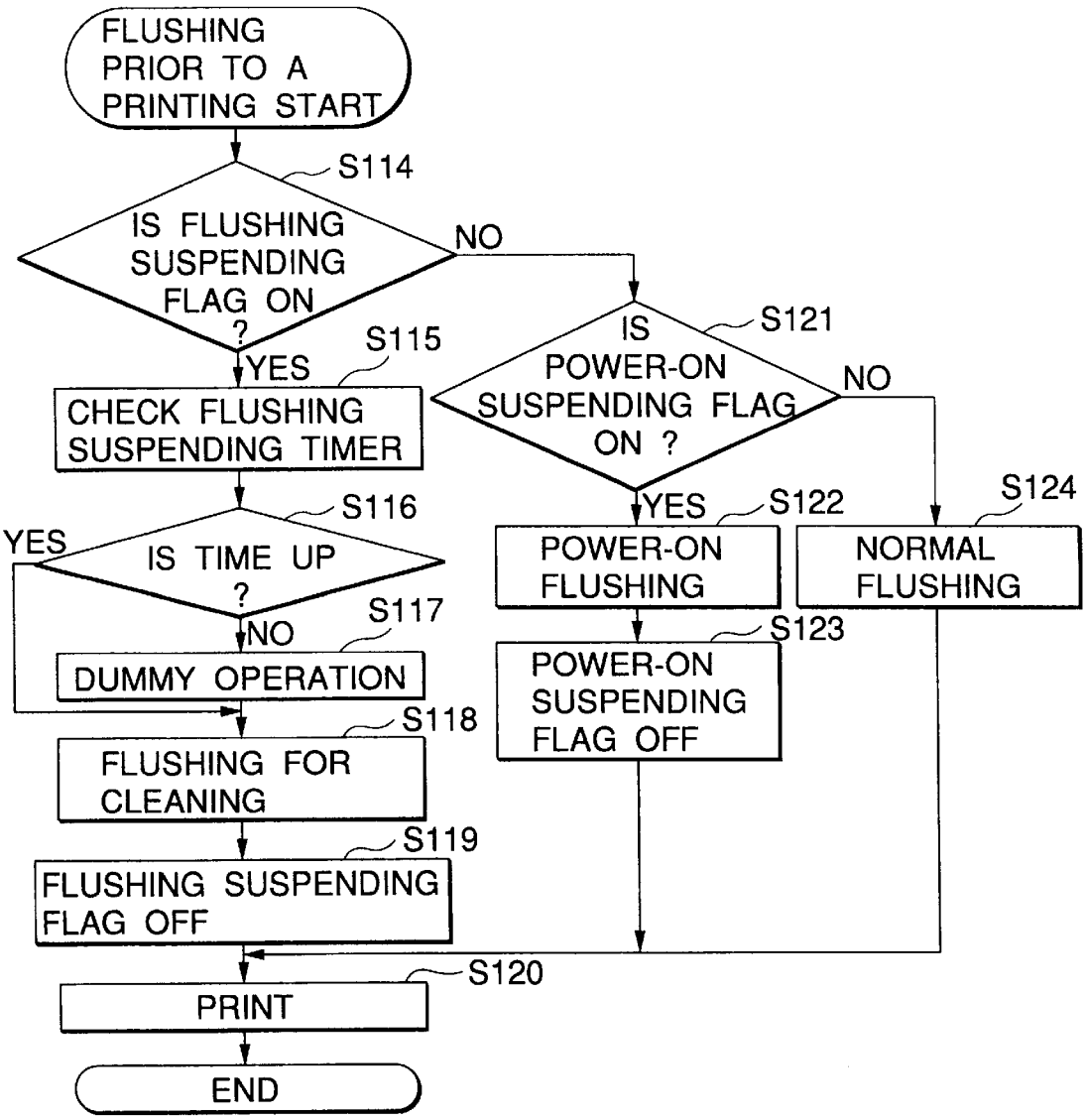
FIG. 4 is a flowchart illustrating the operation for flushing processing prior to a printing start.

When the printing of all the print data is thus finished (S111), the printing controlling means 20 moves the recording heads 7 and 8 to ink receivers such as the caps 12 and 13, and causes flushing on completion of printing to be performed by the flushing controlling means 30 with respect to the recording heads 7 and 8, and the operation waits for the input of ensuing print data (S105). After printing is finished and a power-off command is given from the power on/off command switch 34 (S110), the flushing controlling means 30 executes power-off flushing processing (S112) prior to stopping the supply of operating power to the apparatus (S113). Flushing Processing Prior to Printing Start (FIG. 4)

If the flushing suspending flag is on (S114), the flushing controlling means 26 checks the time measured by the flushing suspending timer 27 (S115). If the time measured by the flushing suspending timer 27 is up (S116), the air bubbles which were entrained by cleaning and the like have been reduced or have already defoamed by that time. Accordingly, since the air bubbles will not grow to such sizes that would cause faulty printing even by a pressure change resulting from the pressurization of the pressure generating chamber by flushing, strong flushing for cleaning is performed (S118) so as to allow the ink whose viscosity has increased in the pressure generating chamber and in the vicinities of the nozzle openings to be discharged into the caps 12 and 13, thereby preventing the clogging during printing in advance. Upon completion of the flushing for cleaning, the flushing suspending flag is set to OFF (S119), and the printing operation is started (S120).

Such flushing for cleaning is executed by applying a voltage waveform with a short period T1 whose absolute values of a rise rate "a" and a fall rate "b" are large and whose holding time t1 at a fixed voltage V0 is short, as shown in FIG. 8(*a*), or by applying, as required, a signal whose voltage V1 is set at a large level, as shown in FIG. 8(*b*).

On the other hand, if the time measured by the flushing suspending timer 27 is not up (S116) as a result of a check of the time measured by the flushing suspending timer 27 (S115), the carriage 1 and the pump unit 16 are operated to impart vibrations to the recording heads 7 and 8. As a result, the dissolution of the air bubbles into the ink is promoted, and the user is notified of the fact that the apparatus is still in the operative state, thereby preventing the user from turning the power off by mistake (S117). In particular, if the pump unit 16 is operated in the state in which the recording heads 7 and 8 are retreated from the capping position, the ink which was discharged into the caps 12 and 13 can be discharged into the waste ink tank, so that the operating efficiency of the overall apparatus can be improved without requiring a particular discharging process.

After the operation of the carriage 1 and the pump unit 16 for a fixed time, the air bubbles taken in by cleaning and the like become reduced or defoamed due to the lapse of that time, so that the aforementioned strong flushing for cleaning is performed (S118). After the completion of the flushing operation, the flushing suspending flag is set to OFF (S119), and the printing operation is started (S120).

On the other hand, if the flushing suspending flag is off (S114), and the power-on suspending flag is on (S121), the air bubbles taken in by cleaning and the like are not present, so that it is unnecessary to take the growth of air bubbles into consideration. Hence, power-on flushing is executed (S122) to discharge the ink whose viscosity has increased in the vicinities of the nozzle openings, the power-on suspending flushing is then set to OFF (S123), and the printing operation is started (S120). Meanwhile, if the power-on suspending flushing is ON (S121), the normal flushing is performed (S124) to discharge the ink whose viscosity has increased in the vicinities of the nozzle openings, and then the printing operation is started (S120).

Figure 5:
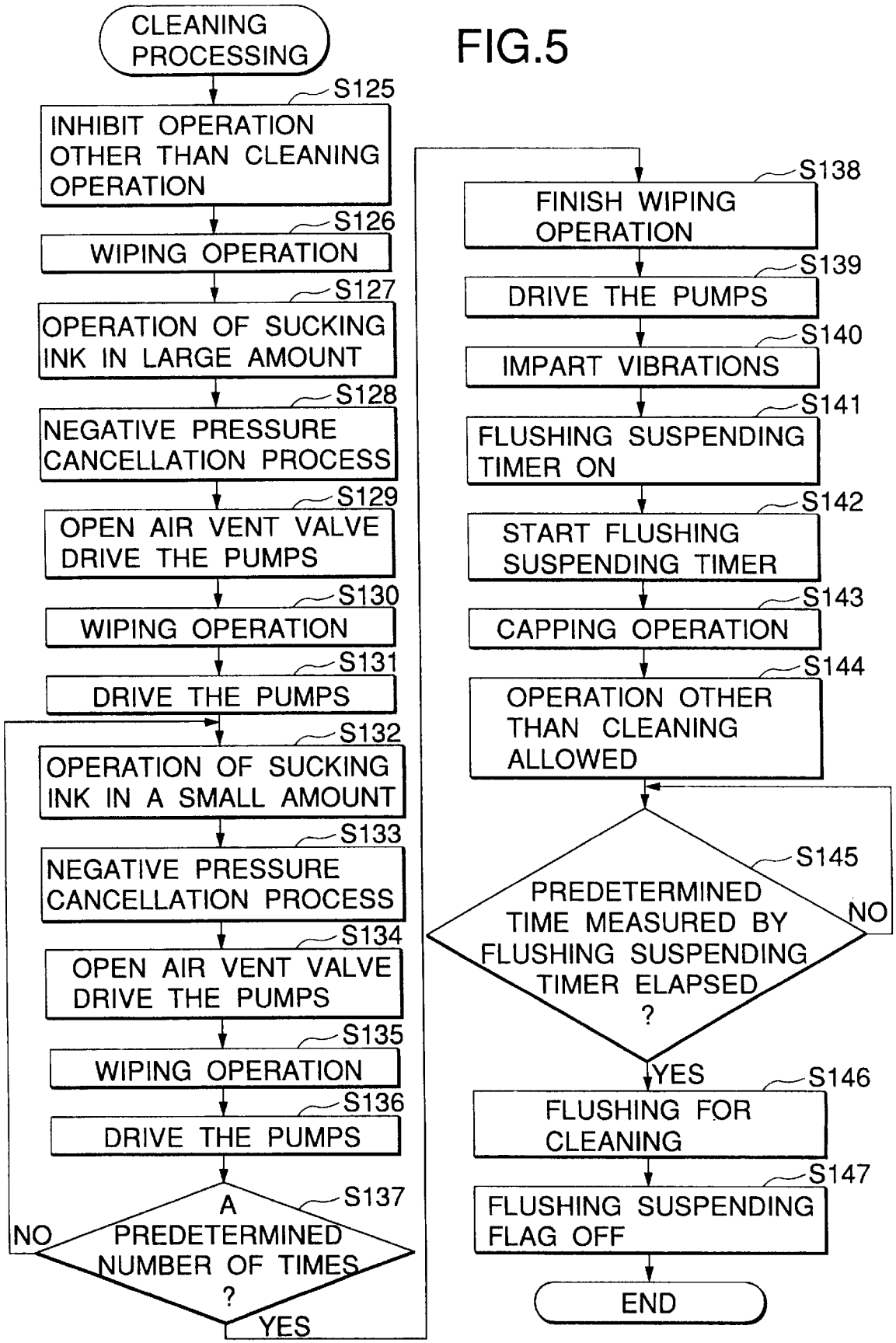
FIG. 5 is a flowchart illustrating the operation for cleaning processing.

Cleaning Processing (FIG. 5)

When a signal is outputted from the cleaning-command detecting means 26 by the operation of the cleaning command switch 35 or the like, the cleaning controlling means 25 inhibits all the operations that are unnecessary for cleaning, such as the paper feeding operation (S125), and causes the wiping blade 17 to advance into the passage of movement of the recording heads 7 and 8 by means of the wiper driving means 29. Then, by controlling the motor 3 by means of the wiping controlling means 23, the recording heads 7 and 8 are relatively moved with respect to the wiping blade 17 to wipe the nozzle plates of the recording heads 7 and 8 (S126), thereby removing dust and paper dust off the nozzle plates.

Next, the carriage 1 is moved to the capping position to start an operation of large suction of ink from the recording heads 7 and 8 (S127).

Figure 9:
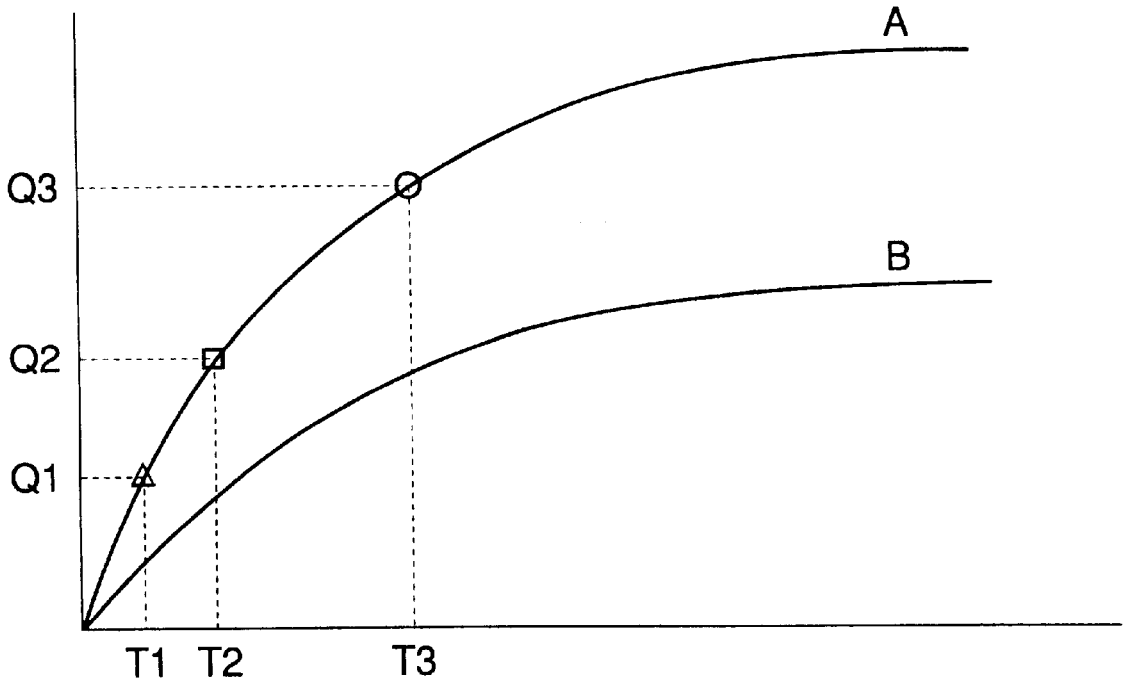
FIG. 9 is a diagram illustrating a suction force of the pump of the apparatus.
Figure 10A:
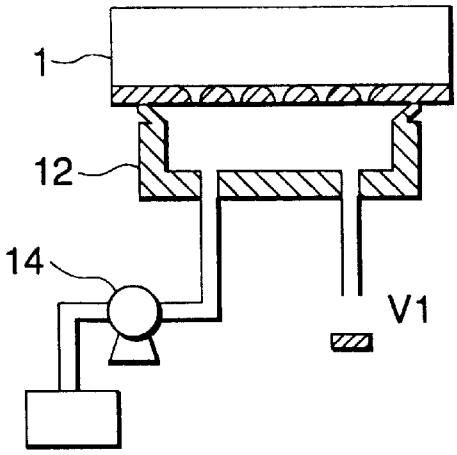
FIGS. 10(*a*) to 10(*d*) are explanatory diagrams illustrating internal states of a cap during a first half of a large suction process, respectively.
Figure 10B:
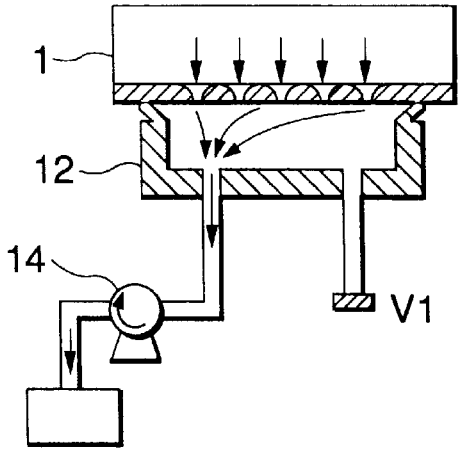
Figure 10C:
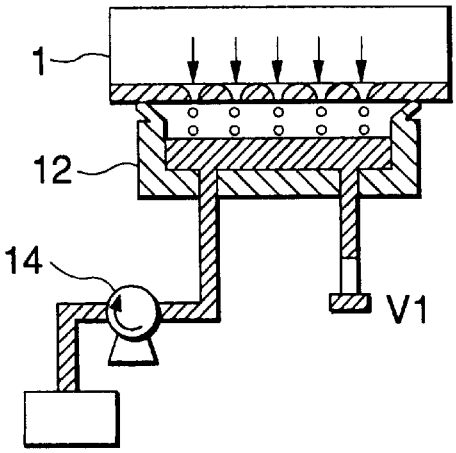
Figure 10D:
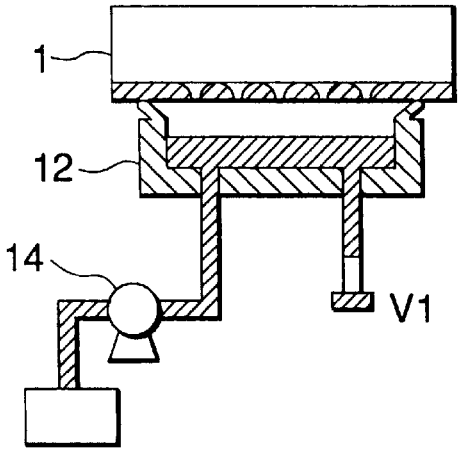

It should be noted that the suction pumps 14 and 15 are capable of demonstrating two kinds of suction capabilities, i.e., large suction (curve A in FIG. 9) and small suction (curve B in FIG. 9), depending on their driving speeds, and their suction capabilities (Q1–Q3) increase with the operating time (T1–T3).

Namely, in a state in which the recording heads 7 and 8 are sealed by the caps 12 and 13 (FIG. 10(*a*)), and the air vent valves V1 and V2 connected to the caps 12 and 13 are closed, the suction pumps 14 and 15 are driven at high speed for a predetermined time T3, thereby building up strong negative pressure in the caps 12 and 13 (FIG. 10(*b*)).

This suction force of the suction pumps 14 and 15 due to the high-speed driving causes the negative pressure to be built up in the caps 12 and 13, and concurrently causes strong negative pressure to be applied to the recording heads 7 and 8 as well. Consequently, as shown in FIG. 14, rapid flow of ink is induced in nozzle openings N in a nozzle plate P, a pressure generating chamber H, a reservoir R, an ink channel L, and an ink supplying needle C, thereby making it possible to discharge the air bubbles stagnating therein by causing them to be carried along by the flow of the ink.

Figure 14:
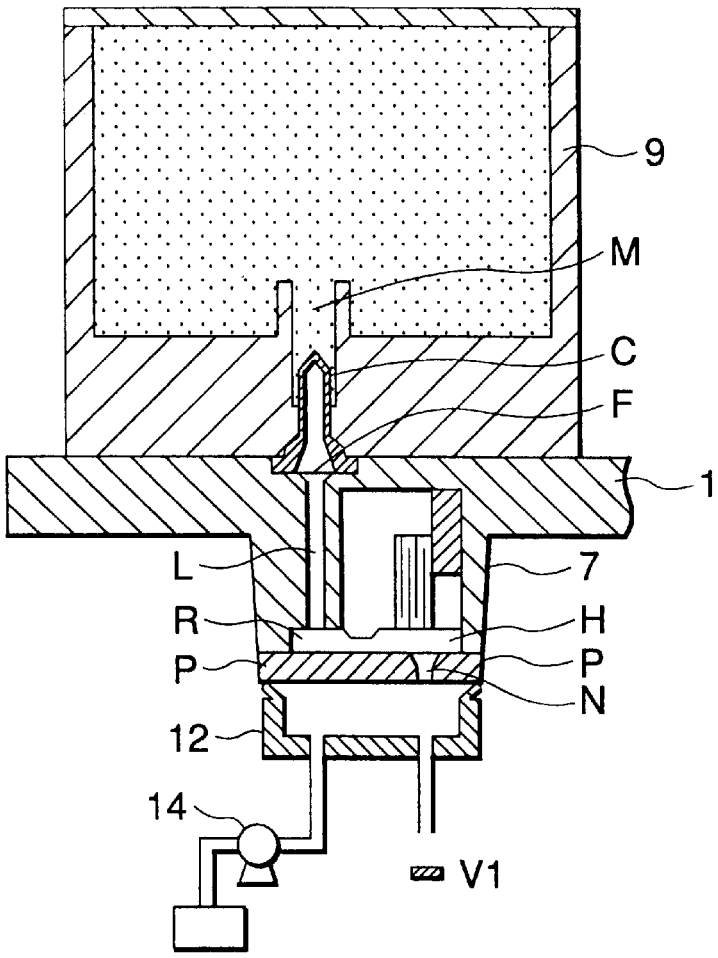
FIG. 14 is an explanatory diagram illustrating ink channels from an ink cartridge to a nozzle opening.

One of the following amounts is selected as the amount of discharge due to this suction, and makes it possible to reliably discharge the ink with increased viscosity and air bubbles which are present in these channels, as shown in FIG. 14:

(1) an amount corresponding to the capacity of portions ranging from the nozzle openings N in the nozzle plate P to the pressure generating chamber H and the reservoir R, (2) an amount corresponding to the capacity of portions ranging from the nozzle openings N to the ink supplying needle C including the ink channel L, (3) an amount corresponding to the capacity of portions ranging from the nozzle openings N to an ink supplying port M of the ink cartridge 9, and (4) an amount sufficient to discharge air bubbles in a filter F disposed downstream of the ink supplying needle C.

If negative-pressure cancellation processing is executed in the state in which such strong negative pressure is left built up as it is (S128), ink in an amount commensurate with the negative pressure is discharged from the recording heads 7 and 8 into the caps 12 and 13 (FIG. 10(*c*)). Thus, after the lapse of a predetermined time, when the capacities of the space in the caps 12 and 13 are reduced by the ink discharged from the recording heads 7 and 8, and the negative pressure becomes weakened to the level of the atmospheric pressure, the discharge of the ink from the recording heads 7 and 8 is stopped (FIG. 10(*d*)). As the negative pressure built up in the caps 12 and 13 is thus canceled, it is possible to prevent air from flowing abruptly into the caps 12 and 13 through the valves V1 and V2 when the air vent valves V1 and V2 are opened on the next occasion, thereby making it possible to prevent the menisci from becoming destroyed. Accordingly, the length of the time spent in this negative-pressure cancellation processing is set in correspondence with the amount of suction, the capacities of the caps 12 and 13, and the viscosity of the ink. Further, the more numerous the number of nozzle openings of the recording heads 7 and 8, the shorter the aforementioned time is set to be.

Figure 11A:
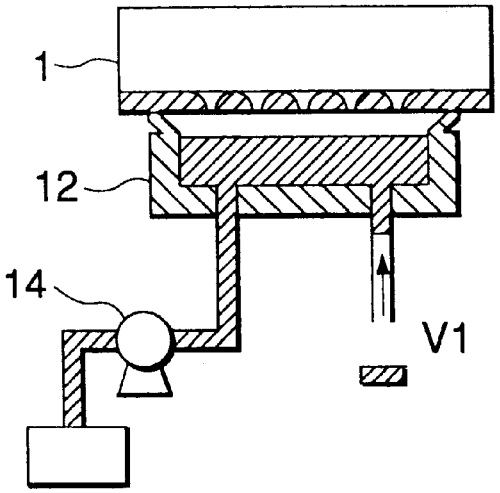
FIGS. 11(*a*) to 11(*c*) are explanatory diagrams illustrating internal states of the cap during a latter half of the large suction process, respectively.
Figure 11B:
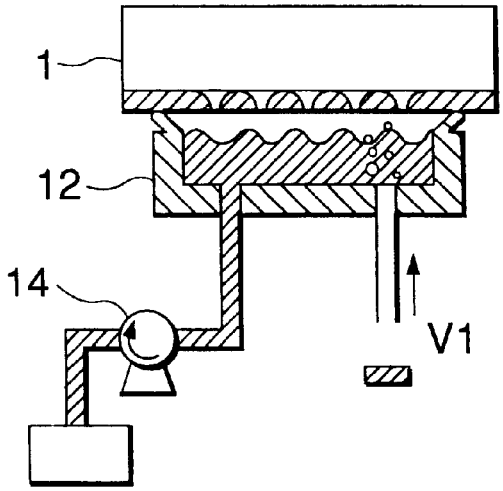
Figure 11C:
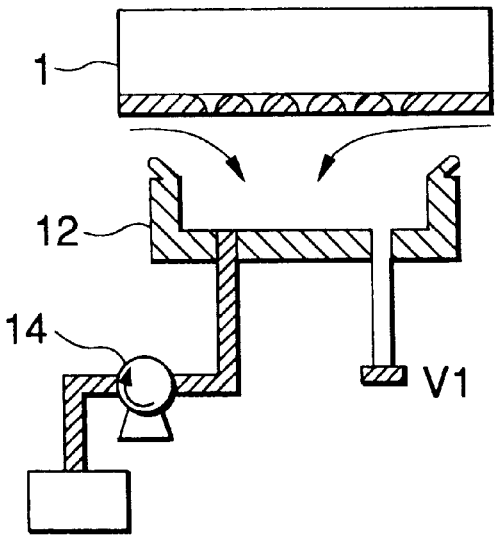
Figure 12A:
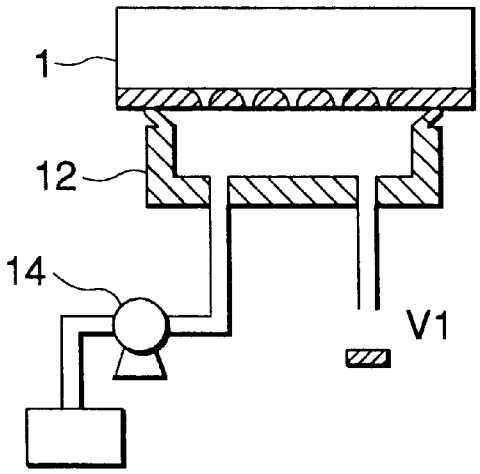
FIGS. 12(*a*) to 12(*d*) are explanatory diagrams illustrating internal-states of the cap during a first half of a small suction process, respectively.
Figure 12B:
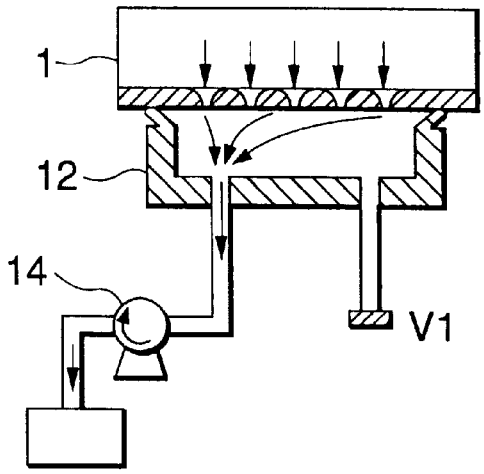
Figure 12C:
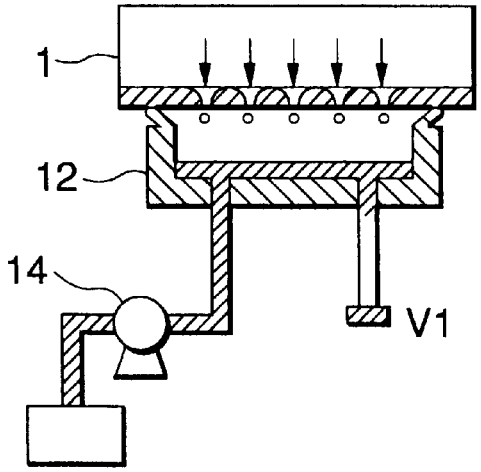
Figure 12D:
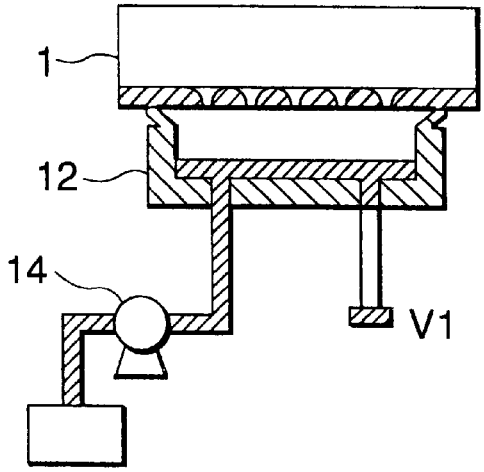

At a stage when the pressure in the caps 12 and 13 has risen to the level of the atmospheric pressure or up to a level persisting immediately before then through the above-described negative-pressure cancellation processing, the air vent valves V1 and V2 of the caps 12 and 13 are opened (FIG. 11(*a*)), and a suction operation is executed by intermittently driving the suction pumps 14 and 15 at low speed (S129).

Figure 7:
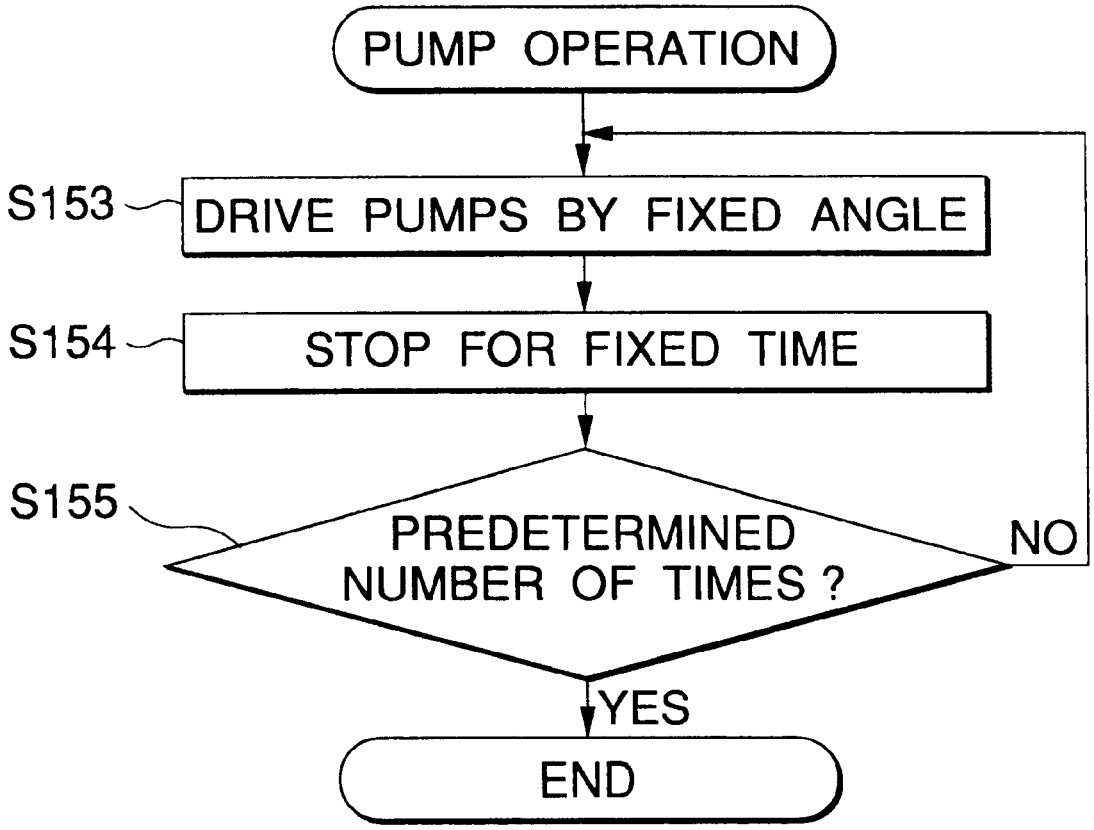
FIG. 7 is a flowchart illustrating the operation for power-off cleaning processing.
Figure 8A:
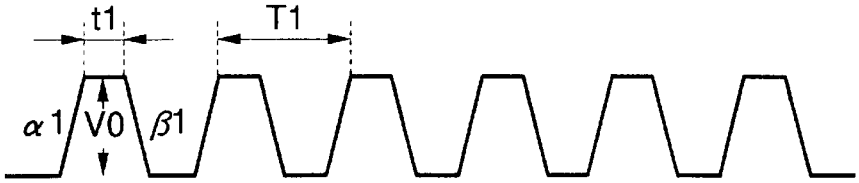
FIGS. 8(*a*) to 8(*f*) are waveform diagrams illustrating signals applied to a recording head during flushing, respectively.
Figure 8B:
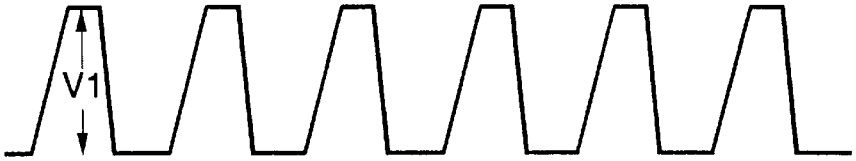
Figure 8C:
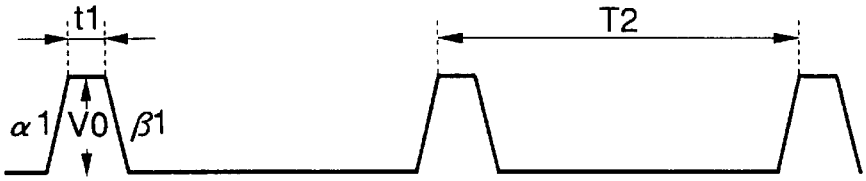
Figure 8D:
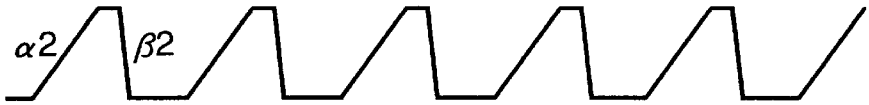
Figure 8E:
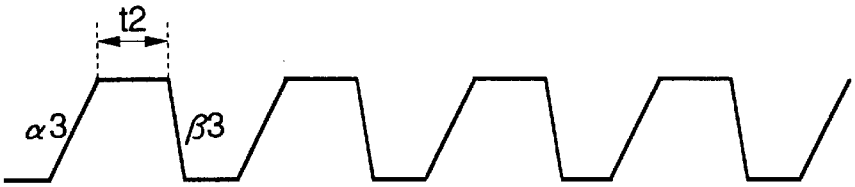
Figure 8F:
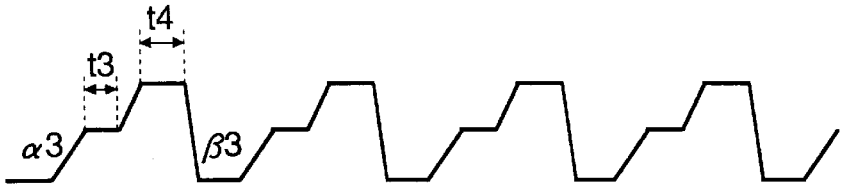
Figure 8G:
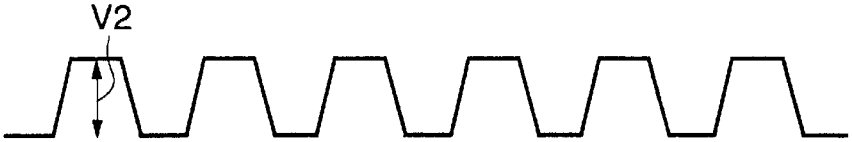

This operation of the suction pumps can be realized by effecting control such as the one shown in FIG. 7.

That is, in the aforementioned operation of the suction pumps, an operation in which the suction pumps 14 and 15 are rotated (S153) at low speed by a fixed angle, e.g., about 15 steps in the driving of a pulse motor having a 48-step arrangement (S153), and are then stopped (S154) for a fixed time, e.g., for about 0.1 second is repeated (S155) a plurality of times, e.g., about 20 times.

The amount of suction in this process is set to at least about 0.5 to 2 times the capacity of the caps 12 and 13, preferably to an amount in which the capacities of pipelines connecting the caps 12 and 13 and the valves V1 and V2 are also added. Thus, an amount is selected which is capable of discharging the ink in the caps 12 and 13 as much as possible, while suppressing bubbling due to the entrainment of air by driving the suction pumps 14 and 15 at low speed.

Thus, since the air vent valves V1 and V2 are opened immediately before the pressure in the caps 12 and 13 reaches the level of the atmospheric pressure, and the suction pumps 14 and 15 are operated, the caps 12 and 13 can be maintained in a state of negative pressure relative to the recording heads 7 and 8. Therefore, it is possible to effectively discharge the ink in the caps 12 and 13 by the influx of the air while preventing the ink discharged into the caps 12 and 13 from flowing reversely to the nozzle openings due to the capillary action of the nozzle openings.

Upon completion of discharge of the ink in the caps 12 and 13, the cleaning controlling means 25 releases the recording heads 7 and 8 from sealing by the caps 12 and 13, moves the recording heads 7 and 8 to the cleaning position, and causes the wiping blade 17 to advance into the passage of movement of the recording heads 7 and 8 to wipe the nozzle plates of the recording heads 7 and 8 (S130). As a result, it is possible to wipe off the ink containing the air bubbles which were produced in the caps during the suction of the ink and attached to the nozzle plates.

Figure 15:
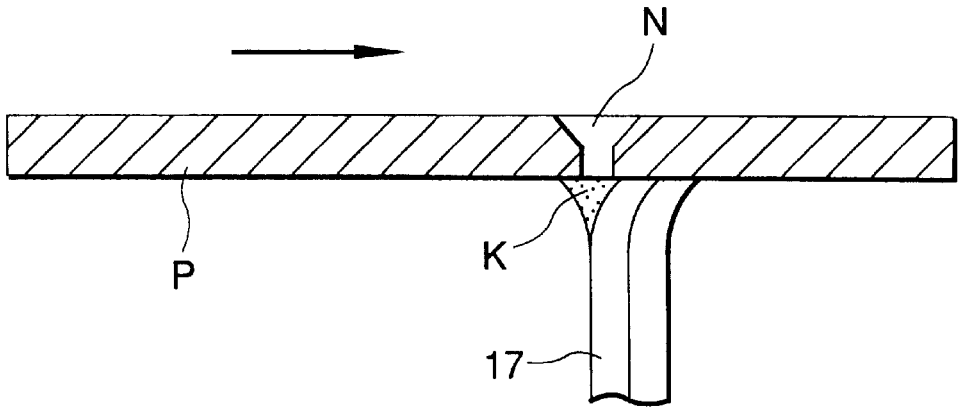
FIG. 15 is an explanatory diagram illustrating the ink which is attached to a wiping blade during wiping.

In this wiping, the following two modes have been prepared: a low-speed mode in which wiping is effected by moving the carriage 1 at low speed and a high-speed mode in which wiping is effected by moving the carriage 1 at high speed which is about 2.5 times the speed of the low-speed mode. Preferably, the wiping in the high-speed mode is executed by moving the carriage 1 at a speed of about 0.1 to 0.5 m/s, while the wiping in the low-speed mode is executed by moving the carriage 1 at a speed of about 0.05 to 0.3 m/s. By virtue of the provision of these two kinds of modes, the high-speed mode is first executed to wipe off the ink droplets attached to the nozzle plates, and then the low-speed mode is executed to remove an ink layer on the surface while preventing the destruction of the menisci as much as possible. In addition, it is possible to make compatible the improvement of the rate of removal of ink droplets and the prevention of the destruction of the menisci, thereby making it possible to enhance the wiping efficiency. Further, after most of the ink attached to the nozzle plates has been wiped off by the wiping in the high-speed mode, and has been wiped off by the wiping blade, the wiping operation can proceed to the wiping operation in the low-speed mode. Accordingly, in the wiping in the low-speed mode, it is possible to reduce the amount of ink K (FIG. 15) which is present between the wiping blade 17 and the nozzle plate P, so that it is possible to prevent the ink K from becoming pulled in toward the nozzle openings N by the capillary action of the nozzle openings N during the wiping in the low-speed wiping, thereby making it possible to finish the wiping operation in a state in which the damage to the menisci is light.

Figure 16:
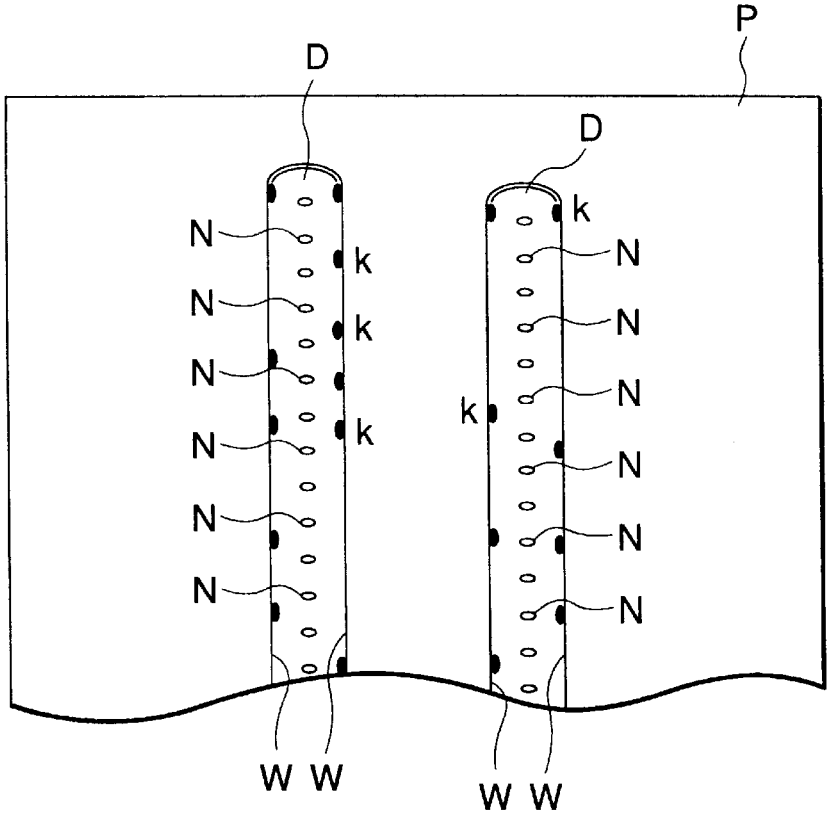
FIG. 16 is a diagram illustrating an example of a nozzle plate in which a crater portion is formed in the vicinities of nozzle openings.

In addition, in a case where a recessed portion D is formed in such a manner as to surround the nozzle openings N, as shown in FIG. 16, relatively large foreign matter, such as ink dregs "k" and the like, is wiped against a wall W of the recessed portion D by the wiping in the high-speed mode so as to be removed to a position where it does not affect the nozzle openings N. Then, by the wiping in the low-speed mode, areas where the foreign matter remains unwiped in the vicinities of the nozzle openings N are eliminated while the rebound of the wiping blade 17 at a boundary of the recessed portion D is prevented as much as possible, thereby making it possible to reliably clean the nozzle plates N.

Upon completion of wiping, a suction pump process is executed (S131) in which the suction pumps 14 and 15 are driven at high speed with the air vent valves V1 and V2 closed and with the caps 12 and 13 released from the recording heads 7 and 8. As a result, the ink remaining in the caps 12 and 13 is discharged into the waste ink tank without applying negative pressure to the recording heads 7 and 8.

The amount of -suction in this process is set to at least about 0.5 to 5 times the capacity of the caps 12 and 13, preferably to an amount in which the capacities of pipelines connecting the caps 12 and 13 and the suction pumps 14 and 15 are also added. Meanwhile, ink absorbent plates such as sponges are accommodated in the caps 12 and 13, and the ink absorbed therein functions not only as a humectant during capping but also as priming water, and absorbs the ink attached to the peripheries of the caps 12 and 13 by capillary action. Hence, the suction force should preferably be of such a measure that the amount of ink with which the ink absorbing plate is impregnated becomes 70% or less of the amount of ink with which the ink absorbing plate can be impregnated.

Thus, wiping is performed after most of the ink remaining in the caps 12 and 13 has been discharged to the waste ink tank with the recording heads 7 and 8 sealed by the caps 12 and 13 and the valves V1 and V2 open. Subsequently, after taking the step of opening the recording heads 7 and 8 and reliably discharging the ink remaining in the caps 12 and 13 to the waste ink tank, wiping is performed immediately with the recording heads 7 and 8 left open from the caps 12 and 13. Consequently, during the suction operation period of normally about 5 seconds, which is required for discharging the ink remaining in the caps 12 and 13 to the waste ink tank with the caps 12 and 13 open, wiping can be performed in a wet state while preventing the drying of the ink attached to the nozzle plates and before the ink attached to the nozzle plates is sucked into the nozzle openings.

After the execution of large suction is completed and the processing of cancellation of negative pressure is finished, a large amount of ink remains stagnating in the caps 12 and 13, so that as the air vent valves V1 and V2 are opened, the ink in the caps 12 and 13 is sucked by the suction pumps 14 and 15 while producing air bubbles (FIG. 11(*b*)), and is discharged into the waste ink tank (FIG. 11(*c*)).

It should be noted that, in the above-described process, there is the possibility of the presence of nozzle openings in a state in which air bubbles have been mixed in the nozzle openings, destroying the menisci. Therefore, to repair the breakage of the menisci and the like, the cleaning controlling means 25 executes the small suction operation with respect to the recording heads 7 and 8 (S132). Namely, the cleaning controlling means 25 causes the recording heads 7 and 8 to be sealed by the caps 12 and 13 (FIG. 12(*a*)), drives the suction pumps 14 and 15 at high speed for a shorter time than during the large suction in the state in which the air vent valves V1 and V2 are closed, thereby allowing the caps 12 and 13 to build up weak negative pressure so as to discharge the ink in the caps 12 and 13 (FIG. 12(*b*)). Then, if the weak negative pressure built in the caps 12 and 13 is left as it is in the state of being applied to the recording heads 7 and 8, the ink is discharged from the recording heads 7 and 8 (FIG. 12(*c*)).

When the negative pressure cancellation processing is thus completed (S133), the discharge of the ink from the recording heads 7 and 8 stops when the negative pressure in the caps 12 and 13 has weakened to the level of the atmospheric pressure (FIG. 12(*d*)). The amount of discharge of ink at this time decreases by the portion in which the negative pressure has weakened as compared with the case of FIG. 10(*c*).

Figure 13A:
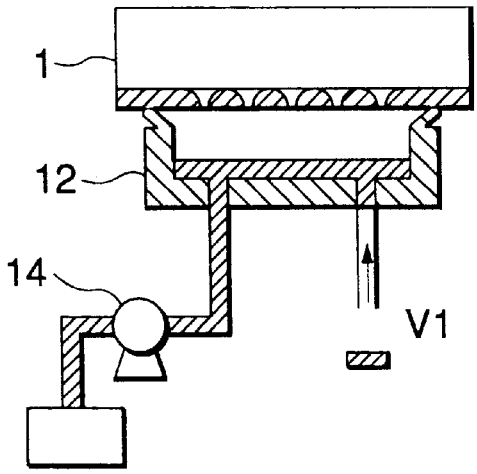
FIGS. 13(*a*) to 13(*c*) are explanatory diagrams illustrating internal states of the cap during a latter half of the small suction process, respectively.
Figure 13B:
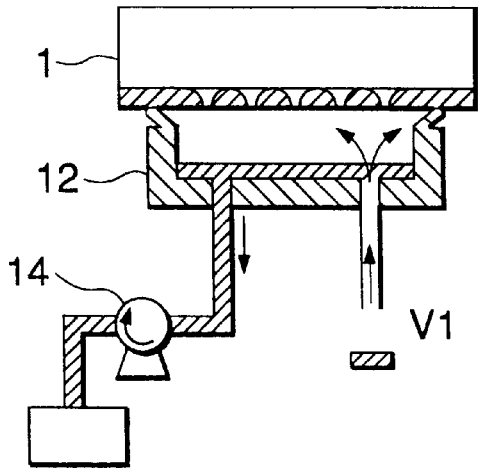
Figure 13C:
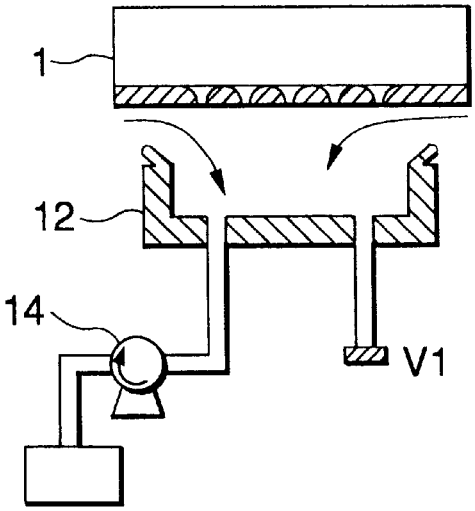

Immediately after the small suction, only a small amount of ink stagnates in the caps 12 and 13, so that air bubbles are not produced even if the air vent valves V1 and V2 are opened (FIG. 13(*a*)). In this state, the suction pumps 14 and 15 are driven at low speed, and the ink stagnating in the caps 12 and 13 is thereby sucked with the recording heads 7 and 8, sealed without bubbling and is discharged into the waste ink tank (FIG. 13(*b*)) (S134). In addition, even if the ink in the caps. 12 and 13 bubbled during the discharge of ink, since the amount of ink remaining in the caps 12 and 13 is small, the degree of bubbling is small, and the bubbles do not come into contact with the nozzle plates, so that the menisci are not destroyed.

Next, the cleaning controlling means 25 moves the recording heads 7 and 8 to the operating position of the wiping blade 17, and executes the wiping of the nozzle plates of the recording heads 7 and 8 in the low-speed mode, i.e., finish wiping (S135). This wiping should preferably be executed within 10 seconds at the longest-after completion of the suction operation in (S132). If the wiping is thus executed within the lapse of a short time, the ink on the nozzle plates can be wiped off by the wiping blade 17 before the ink attached to the nozzle plates during the suction of the ink flows reversely into the nozzle openings.

Next, the recording heads 7 and 8 are released from the caps 12 and 13, the air vent valves V1 and V2 are closed again, and the suction pumps 14 and 15 are driven at high speed so as to discharge the ink remaining in the caps 12 and 13 into the waste ink tank (FIG. 13(*c*)) (S136). The amount of suction in this process is set to at least about 0.5 to 5 times the capacity of the caps 12 and 13, preferably to an amount in which the capacities of pipelines connecting the caps 12 and 13 and the suction pumps 14 and 15 are also added. Meanwhile, ink absorbent plates such as sponges are accommodated in the caps 12 and 13, and the ink absorbed therein functions not only as a humectant during capping but also as priming water, and absorbs the ink attached to the peripheries of the caps 12 and 13 by capillary action. Hence, the suction force should preferably be of such a measure that the amount of ink with which the ink absorbing plate is impregnated becomes 70% or less of the amount of ink with which the ink absorbing plate can be impregnated.

Such a process in (S132) to (S136) is repeated, as required, by a plurality of times (S137). However, when the process is carried out on the second occasion, the amount of suction of the ink from the recording heads 7 and 8 in (S132) is reduced as compared with the case where the operation in (S132) is executed on the first occasion, thereby making it possible to discharge the air bubbles which are liable to stagnate in the vicinities of the nozzle openings, while suppressing the consumption of the ink and useless pressure changes for the ink in the channels.

At a stage when a predetermined number of operations of suction by small amounts have been completed in the above-described manner, the wiping operation in the aforementioned low-speed mode is executed (S138). The menisci in the recording heads 7 and 8 are restored to virtually perfect states by the wiping operation in the low-speed mode. Then, after the recording heads 7 and 8 are retreated to the position where they do not oppose the caps 12 and 13, the suction pumps 14 and 15 are operated to discharge the ink in the caps 12 and 13 (S139). As the ink in the caps 12 and 13 is thus sucked in the state in which the recording heads 7 and 8 do not oppose the caps 12 and 13, it is possible to prevent ink bubbles produced during suction or very small ink droplets caused by their breakage from attaching to the nozzle plates.

In addition, in a case where the suction pumps 14 and 15 are formed by tube suction pumps in which tubes made of silicone rubber or the like are wiped by a roller, an operation is needed for causing the roller to be spaced apart from the tubes so as to prevent the permanent set of the tubes after the completion of suction. At this time, it is possible to prevent ink droplets, which jumped out of the caps 12 and 13 owing to the action of positive pressure caused by the repulsion or the like of the tubes, from becoming attached to the recording heads 7 and 8.

Figure 17A:
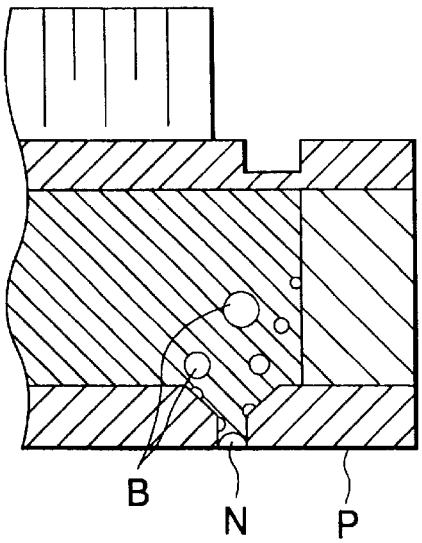
FIGS. 17(*a*) and 17(*b*) are explanatory diagrams illustrating the states of air bubbles in the vicinity of the nozzle opening immediately after cleaning processing and when the time measured by a flushing suspending timer is up, respectively.
Figure 17B:
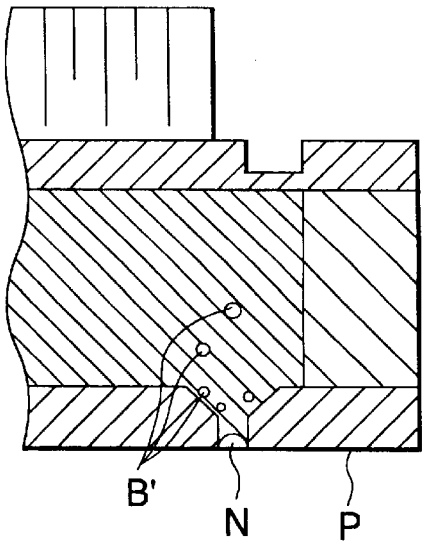

Then, vibrations are imparted to the air bubbles stagnating in the vicinities of the nozzle openings such as by rotating the motor 3 forwardly and reversely by the small-vibration controlling means 24 to reciprocate the carriage 1 by very small amounts, or by applying drive signals weaker than those for normal flushing to the recording heads 7 and 8 (S140). Thus, the dissolution into the ink of relatively large air bubbles B (FIG. 17(*a*)) which have been entrained in the vicinities of the nozzle openings due to cleaning or the like is promoted. This causes the air bubbles B to be reduced to very small bubbles B' or disappear (FIG. 17(*b*)).

As for a signal for flushing to be applied in (S140), as shown in FIG. 8(*g*), its voltage V2 is set to be smaller than the voltage VO of the drive signal applied during printing or flushing, and is set such that a pressure change can be imparted to the ink in the pressure generating chamber without causing ink droplets to be discharged from the nozzle openings. After the imparting of vibrations, the flushing suspending flag is set to ON (S141), and the flushing suspending timer 31 is started (S142). As a result, the flushing operation is inhibited until the time measured by the flushing suspending timer 31 is up, e.g., for 10 seconds or more, thereby allowing the air bubbles produced by cleaning to be dissolved into the ink and preventing faulty printing due to the growth of air bubbles due to flushing. It should be noted that the point of time at which the timing operation is started by the flushing suspending timer 31 may be set at the point of time of completion of suction in (S132) in a final cycle in FIG. 5 or at the point of time of completion of finishing wiping in step (S138).

The recording heads 7 and 8 are moved to the capping position to seal the recording heads 7 and 8 by the caps 12 and 13 (S143), and operations which were inhibited are allowed other than the cleaning processing (S144). At a stage when the flushing suspending timer 31 has measured a predetermined time (S145), i.e., after the lapse of the time required for the air bubbles in the nozzle openings N to be dissolved into the ink and disappear, or the time required for the air bubbles in the nozzle openings to move to the pressure generating chamber H, or the time required for the air bubbles to disappear or to be reduced to an extent that they will not cause hindrance to printing even by a pressure change due to flushing, flushing for cleaning is executed (S146). Subsequently, the flushing suspending flag is set to OFF, and the operation waits (S147).

Meanwhile, without using the flushing suspending timer 31, flushing for cleaning may be executed after the lapse of a predetermined time by driving the suction pumps 14 and 15 at low speed in step (S139) in FIG. 5 or by appropriately setting the time duration when the imparting of vibrations is continued in step (S140). According to this arrangement, not only can the timer be made unnecessary, but the operation of the apparatus can be sensed by the user's five senses, thereby making it possible to prevent the user from turning the power off by mistake.

The drive signal which is used in flushing subsequent to this cleaning has a waveform shown in FIG. 8(*a*). Specifically, selected among others is a waveform in which, as shown in FIG. 8(*c*), the period is set to a period T2, or a waveform in which, as shown in FIG. 8(*d*), a rate of voltage change $\alpha 2$ on the side for expanding the pressure generating chamber is set to be small to prevent the entrainment of air bubbles from the nozzle openings, while a rate of voltage change $\beta 2$ on the side for shrinking the pressure generating chamber is set to a normal level to discharge sufficient amounts of ink droplets.

In addition, a waveform is selected in which, as shown in FIG. 8(*e*), a rate of voltage change $\alpha 2$ on the side for expanding the pressure generating chamber is set to be relatively small and a voltage holding time t3 is set to be relatively long to stabilize the menisci, and then a rate of voltage change $\beta 3$ on the side for shrinking the pressure generating chamber is set to a normal level to discharge sufficient amounts of ink droplets. Incidentally, in the waveform shown-in FIG. 8(*f*), the holding time t3 in the signal shown in FIG. 8(*e*) is split into the times t4 and t5 (not shown), in which case, as well, ink droplets can be discharged in the state in which the menisci are stabilized. On the other hand, ink droplets having a large amount of ink per droplet may be discharged by a drive signal in which the voltage V1 set to a high level, as shown in FIG. 8(*b*), or the voltage may be applied at an appropriate period, as shown in FIG. 8(*c*).

After cleaning is thus finished, and the operation proceeds to a waiting state without executing flushing, if a print signal is inputted, flushing prior to a printing start is performed as shown in step (S106) of FIG. 3, making it possible to recover the menisci to a printable state.

Figure 6:
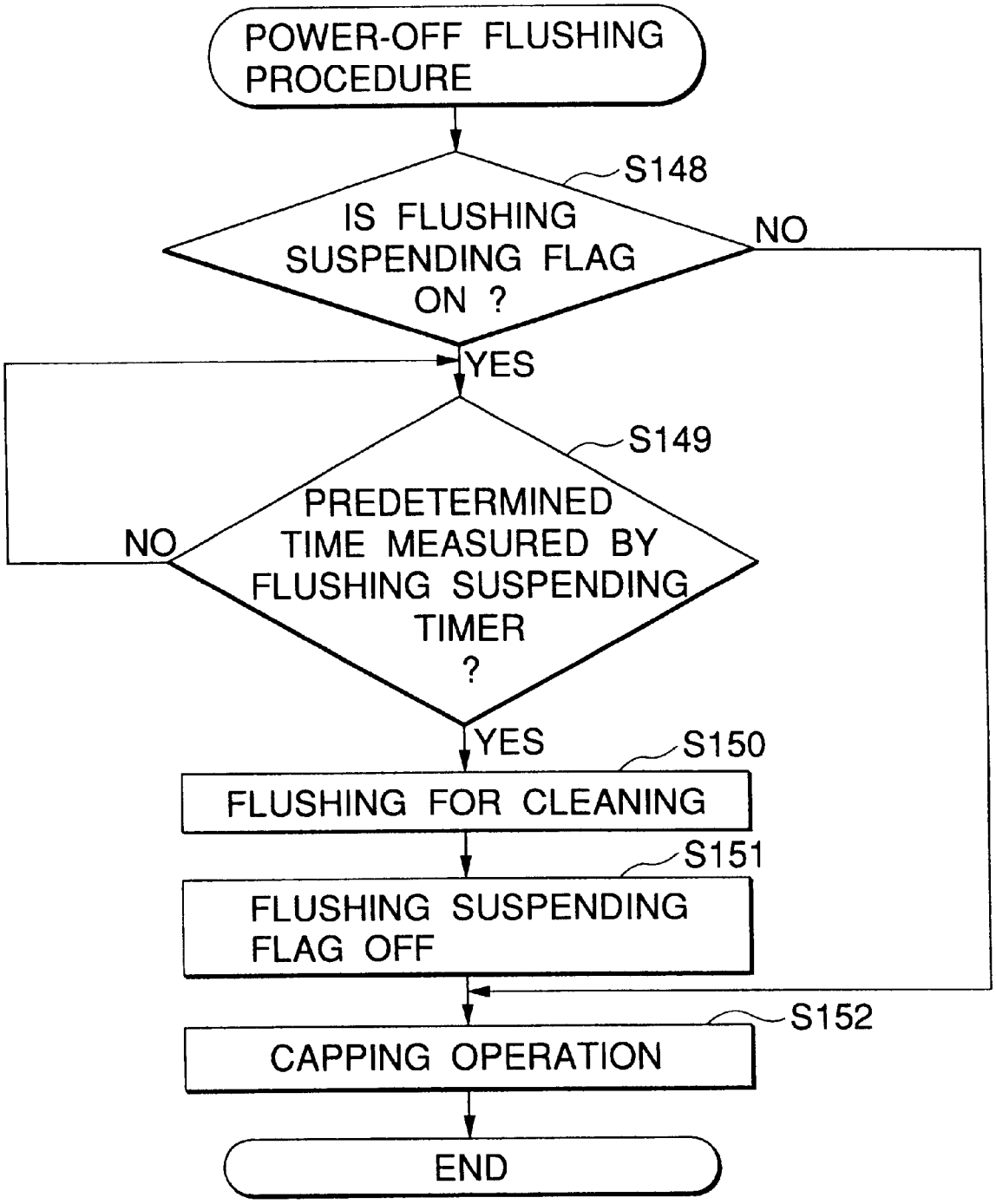
FIG. 6 is a flowchart illustrating the operation of a suction pump.

Power-Off Flushing Processing (FIG. 6)

When the power on/off command switch 34 is operated and a signal is outputted from the power switch detecting means 33, the flushing controlling means 30 detects whether or not the flushing suspending flag is on, and if it is on (S148), at a stage when the flushing suspending timer 31 has measured a predetermined time (S149), flushing for cleaning is executed (S150), and the recording heads 7 and 8 are sealed by the caps 12 and 13 (S151).

As a result, particularly in the case of the color recording head 8, there is a possibility that the mixing of colors has occurred due to the wiping of the nozzle plate by the wiping blade 17, so that if the mixed colors are left as they are for a long time, the color mixture will proceed to the pressure generating chamber. However, the ink with mixed colors can be discharged by flushing, so that when the power is turned on next time, printing will become possible only by light flushing to the extent of discharging the ink in the vicinities of the nozzle openings. Incidentally, when the flushing suspending flag is off, the ink with mixed colors due to cleaning has been discharged, so that the operation proceeds to the capping operation (S152) without executing flushing for cleaning (S151).

It should be noted that, in the above-described embodiment, the operation waits for the flushing suspending timer 31 to time a predetermined time, but-even if flushing for cleaning is executed immediately upon operation of the power on/off command switch 34, the air bubbles disappear through a subsequent long downtime, so that the menisci will have been recovered to a printable state when the power is turned on the next time.

Further, in the above-described embodiment, a description has been given of the case where the supply of driving power to the apparatus is stopped after effecting a predetermining finishing operation upon detecting a signal from the power on/off command switch 34. However, in the case of a recording apparatus which is not provided with such a function, or in the case where driving power is cut off due to the pulling out of a power plug of the recording apparatus from a socket outlet or due to a power failure, since at least the presence or absence of flushing is stored as the on or off state of the flag, when the power is turned on next time, flushing may be executed by incorporating the state of the flag at the time of cut-off of the power into the flushing processing prior to a printing start in (S106) in FIG. 3.

What is claimed is:

1. An ink-jet type recording apparatus comprising:

an ink-jet recording head for ejecting ink droplets in correspondence with print data, said recording head having a plurality of nozzle openings;

means for capping and sealing said recording head and communicating with the atmosphere selectively, and for receiving negative pressure from suction pump;

a wiping blade for wiping a surface of said nozzle openings of said recording head;

means for controlling flushing in which the ink droplets are ejected from said recording head to prevent clogging of the nozzle openings of said recording head;

means for controlling cleaning of said recording head by allowing said suction pump to suck ink from said recording head and for allowing said wiping blade to wipe said recording head; and timing means for starting timing after completion of cleaning and for measuring a time duration required for at least one of disappearance and reduction of air bubbles occurring in a vicinity of the nozzle openings after cleaning;

wherein said flushing controlling means executes flushing when the time duration measured by said timing means is up.

2. The ink-jet type recording apparatus according to claim 1, wherein said flushing controlling means operates said timing means upon completion of the cleaning.

3. The ink-jet type recording apparatus according to claim 1, wherein said timing means starts the timing operation on a basis of a final suction operation in the cleaning process.

4. The ink-jet type recording apparatus according to claim 1, wherein said timing means starts the timing operation on the basis of a final wiping operation in the cleaning.

5. The ink-jet type recording apparatus according to claim 1, wherein the time duration until time is up is a time duration required for the air bubbles in the vicinity of the nozzle openings of said recording head to be dissolved in the ink and disappear.

6. The ink-jet type recording apparatus according to claim 1, wherein the time duration until time is up is a time duration required for the air bubbles in the vicinity of the nozzle openings of said recording head to move.

7. The ink-jet type recording apparatus according to claim 1, wherein the time duration until time is up is 10 seconds or more.

8. The ink-jet type recording apparatus according to claim 1, wherein a time up of said timing means is notified by notifying means, and a state of the time up is stored.

9. The ink-jet type recording apparatus according to claim 8, wherein the flushing is executed prior to a printing start in response to a print signal inputted after the time up, and memory of the state of the time up is erased.

10. The ink-jet type recording apparatus according to claim 1, wherein said cleaning controlling means imparts vibrations to the ink in said recording head upon completion of final cleaning.

11. The ink-jet type recording apparatus according to claim 10, wherein the vibrations to the ink are imparted by very small reciprocating motions of a carriage on which said recording head is mounted.

12. The ink-jet type recording apparatus according to claim 10, wherein the vibrations to the ink are imparted by imparting a drive signal to said recording head.

13. The ink-jet type recording apparatus according to claim 12, wherein the drive signal is constituted by a signal having a waveform different from that during printing.

14. The ink-jet type recording apparatus according to claim 1, wherein an operation other than the flushing is executed during the timing operation by said timing means.

15. The ink-jet type recording apparatus according to claim 14, wherein the operation other than the flushing is driving of said suction pump in a state in which said capping means is released from said recording head.

16. The ink-jet type recording apparatus according to claim 14, wherein the operation other than the flushing is an operation which can be sensed by one or more of the five senses of a user.

17. The ink-jet type recording apparatus according to claim 1, wherein the flushing is executed also in response to the detection of command for turning power off received during the timing operation by said timing means.

18. The ink-jet type recording apparatus according to claim 1, wherein, when a command for turning power off is received before said time is up, said means for capping and sealing seals after completion of the flushing and the supply of power is stopped.

19. The ink-jet type recording apparatus according to claim 1, wherein, when a command for turning power off is received before said time is up, flushing is performed and an indicator indicating completion of the flushing is stored.

20. The ink-jet type recording apparatus according to claim 1, wherein, when a command for turning power off is received before said time is up, the flushing is executed at a stage when the timing operation by said timing means has been completed.

21. The ink-jet type recording apparatus according to claim 1, wherein, when a command for turning power off is received before said time is up, the flushing is executed after the time measured by said timing means is up.

22. The ink-jet type recording apparatus according to claim 1, wherein, when a command for turning power off is received before said time is up, the flushing is executed by applying a signal, having a waveform different from that during printing, to said recording head.

23. A method of control for use with an ink-jet type recording apparatus having an ink-jet type recording head for ejecting ink droplets in correspondence with print data, said recording head having a plurality of nozzle openings; means for capping and sealing said recording head and communicating with the atmosphere selectively, and for receiving negative pressure from a suction pump; and a wiping blade for wiping a surface of said nozzle openings of said recording head;

setting a time duration for at least one of the disappearance and the reduction of air bubbles from the vicinity of the nozzle openings after a cleaning operation;

cleaning said recording head, including:

sucking ink from said recording head with said suction pump, and wiping said recording head with said wiping blade; then waiting for said time duration; and then flushing said recording head by ejecting ink droplets from said recording head into said means for capping and sealing;

wherein said flushing step is begun in response to a completion of said waiting step.

24. The method of control for an ink-jet type recording apparatus according to claim 23, wherein said waiting step begins based on the occurrence of a final suction operation in said cleaning step.

25. The method of control for an ink-jet type recording apparatus according to claim 23, wherein said waiting step begins based on the occurrence of a final wiping operation in said cleaning step.

26. The method of control for an ink-jet type recording apparatus according to claim 23, wherein said time duration until time is up is 10 seconds or more.

27. The method of control for an ink-jet type recording apparatus according to claim 23, further comprising a step for imparting vibrations to said ink.

28. The method of control for an ink-jet type recording apparatus according to claim 27, wherein said step for imparting vibrations comprises causing very small reciprocating motions of a carriage on which said recording head is mounted.

29. The method of control for an ink-jet type recording apparatus according to claim 27, wherein said step for imparting vibrations comprises providing a drive signal to said recording head without ejecting said ink.

30. The method of control for an ink-jet type recording apparatus according to claim 23, further comprising performing an operation other than flushing during said waiting step.

31. The method of control for an ink-jet type recording apparatus according to claim 30, wherein said operation other than said flushing comprises driving said suction pump in a state in which said capping means is released from said recording head.

32. The method of control for an ink-jet type recording apparatus according to claim 30, wherein said operation other than said flushing comprises an operation which can be sensed by one or more of the five senses of a user.

33. The method of control for an ink-jet type recording apparatus according to claim 23, wherein said flushing step is begun in response to receiving a power-off command during said waiting step.

34. The method of control for an ink-jet type recording apparatus according to claim 23, further comprising, in response to receiving a power-off command during said waiting step:

sealing said recording head after completion of said flushing step, and then stopping the supply of power.

35. The method of control for an ink-jet type recording apparatus according to claim 23, further comprising, in response to receiving a power-off command during said waiting step:

performing said flushing, and storing an indicator indicating completion of said flushing.

36. The method of control for an ink-jet type recording apparatus according to claim 23, further comprising, in response to receiving a power-off command during said waiting step, executing said flushing only after completion of said waiting step.

* * * * *